United States Patent [19]

Schroeder

[11] Patent Number: 4,486,908

[45] Date of Patent: Dec. 11, 1984

[54] SUPPORT BED

[76] Inventor: Warren C. Schroeder, Gellett Suite C-603, 2400 Virginia Ave., NW., Washington, D.C. 20037

[21] Appl. No.: 259,600

[22] Filed: Jul. 23, 1981

[51] Int. Cl.[3] ..... A47C 19/00; A61G 7/00

[52] U.S. Cl. ..... 5/60; 5/430; 5/445; 5/185

[58] Field of Search ..... 5/60, 131, 61, 185, 5/425, 430, 445, 460, 498, 66, 4, 151, 465

[56] References Cited

U.S. PATENT DOCUMENTS

| | | | |
|---|---|---|---|
| 677,671 | 7/1901 | Lausen | 5/430 |
| 796,722 | 8/1905 | Hermann | 5/496 |
| 826,978 | 7/1906 | Whittington | 5/445 |
| 842,973 | 2/1907 | Preston | 5/66 |
| 856,746 | 6/1907 | Valentine | 5/496 |
| 908,845 | 1/1909 | Curtin | 5/445 |
| 1,373,670 | 3/1926 | Plumb | 5/498 |
| 1,698,968 | 1/1929 | Rubenstein | 5/496 |
| 1,740,906 | 12/1929 | Rothauszky | 5/66 |
| 1,925,637 | 8/1933 | Kellar | 5/425 |
| 2,113,286 | 4/1938 | White | 5/465 |
| 2,844,828 | 7/1958 | Stark | 5/425 |
| 3,210,778 | 10/1965 | Robinson | 5/430 |
| 3,335,432 | 8/1967 | Foster | 5/181 |
| 3,344,445 | 10/1967 | Crawford | 5/430 |
| 3,585,660 | 6/1971 | Gottfried et al. | 5/60 |
| 3,800,342 | 4/1974 | Tenteris et al. | 5/60 |
| 4,002,330 | 1/1977 | Johansson | 5/60 |

FOREIGN PATENT DOCUMENTS

| | | | |
|---|---|---|---|
| 7634 | 5/1902 | Austria | 5/482 |
| 363730 | 12/1931 | United Kingdom | 5/185 |
| 370615 | 4/1932 | United Kingdom | 5/185 |
| 448618 | 6/1936 | United Kingdom | 5/185 |
| 1492915 | 11/1977 | United Kingdom | 5/61 |

*Primary Examiner*—Alexander Grosz
*Assistant Examiner*—Michael F. Trettel

[57] ABSTRACT

A power operated bed whereby the sides with mattress move from a normal position to a vertical position for supporting a person's spinal column simultaneously in two distinct planes relieving pressure on the occupant's spinal column. And a bed incorporating a headboard of independent turned spindles and adjustable straps to aid the occupant in shifting body position by the use of ones hands and arms and to further provide body anchors that allow stretch of occupant's spinal column. An arrangement allowing bed sheeting to remain firmly taut to the mattress independent of bed positioning.

6 Claims, 11 Drawing Figures

SUPPORT BED

BACKGROUND OF THE INVENTION

There are many patented design configurations thats intent are to assist in body movements either in treatment or liesure relaxation or movement, all with the intent to facilitate and improve occupant comfort. This invention also serves to this end, but in a manner not heretofore accomplished.

SUMMARY OF THE INVENTION

This invention is to provide a conveniently operated power adjustable bed that will support ones spinal column simultaneously in two distinct planes taking some of the pressure off the spinal column discs. It incorporates further provisions that will relieve back tension and assist in body reconfiguring by the addition of suitable hand and arm grips. And it also allows for reconfiguring ones body without having to continually readjust the bed contour. All this is accomplished with the bedding accessories remaining snugly tight and in position.

DESCRIPTION OF THE PREFERRED EMBODIMENTS

Figure 1:
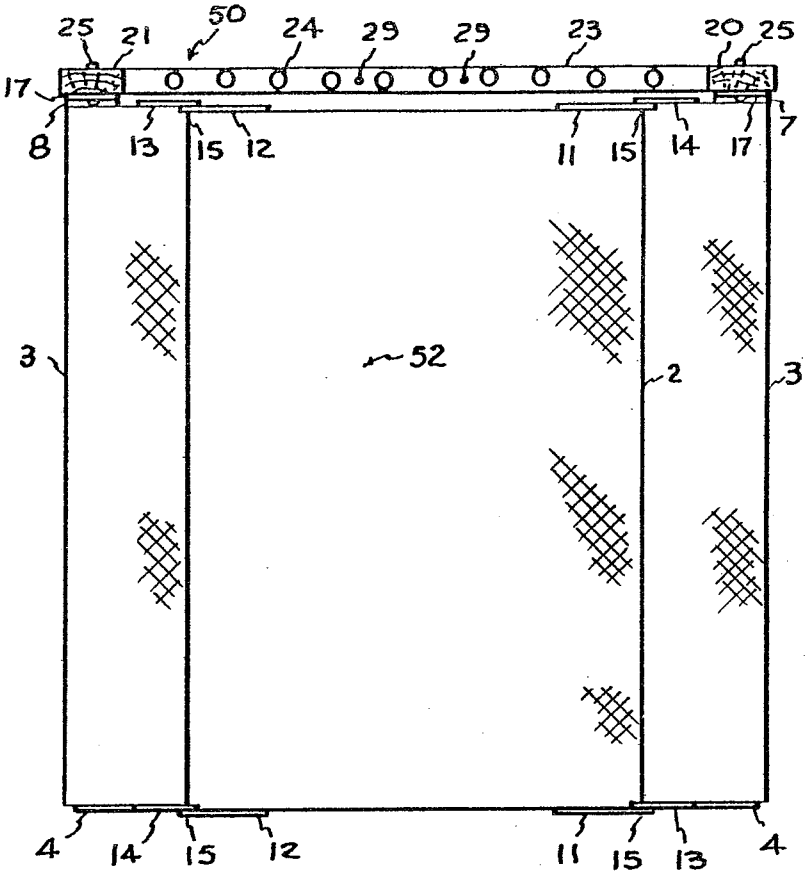
FIG. 1, is the plan view of the bed looking down from the top and showing the mattress arrangement and headboard.
Figure 2:
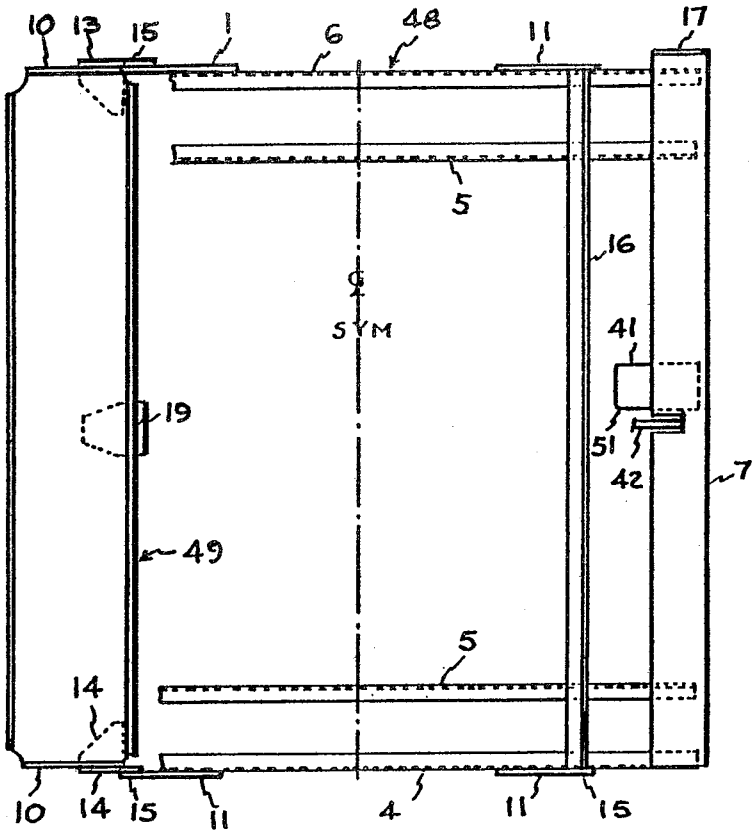
FIG. 2, is a plan view of the bed looking down from the top and showing partially the supporting structure.

FIGS. 1, 2, 4, 5, 6 and 6A, 7 and 7A and 8 and 8A show in general a power operated support bed. FIGS. 3, 9, 10, 11 and 12 show the always stabilized sheet and its attaching means. The support bed 47 is made up in general of a main frame 48, an auxiliary frame 49, a headboard unit 50, a power group 51, a mattress group 52 and a sheet installation group 53.

The main frame 47 comprises one foot end support structure 4, one head end support structure 6, two box beams, 7 left hand, 8 right hand opposite, two intermediate support structures 5, two longitudinal support structures 16 two headboard attach plates 17, two foot end box beam enclosure caps 38, four leg and caster units 18 and a plurality of eye studs 32.

The auxiliary frame 49 comprises two side mattress bottom support pans, 9 left hand, 10 right hand opposite, four outer hinge mountings 11, four inner hinge mountings, two 13 and 14 opposites, a plurality of attaching hardware 39, a plurality of eye studs 32, four hinge bushings 15, four hinge spacer washers 28 and four bushing retainer rings 27.

The headboard 50 comprises one left hand post 20, one right hand post 21, one top rail 22, one lower rail 23, a plurality of turned spindles 24, two control switches 29, a plurality of hand support straps 46, a plurality of attaching hardware 25 and a plurality of hooks 31.

The power group 51, comprises two power units and gear boxes 41, two frame mountings 19, two upper actuator arms 42, two lower actuator arms 43 and two actuator attaching pins 44.

The mattress group 52, comprises one box spring 1, one center mattress 2 and two side mattresses 3.

The sheet installation group 53, comprises one sheet 36, a plurality of eyelets 37, two elastic chords 35, a plurality of eye hooks 33 and two chords 40.

The longitudinal support structures 16 support box spring 1 and runs common to its sides. Foot end support structure 4 and the head end support structure 6 likewise support the head and foot end of box spring 1. They are extended to also support box beams 7 and 8 making up the outermost side structure of the main structure. Intermediate support structure 5 extends generally the full width of the main structure and provides the mounting structure for the leg an caster units 18. Box beam 7 in cross section is of sufficient height to support bottom side mattress support pan 9 in a horizontal position in lieu of box springs beneath the side mattresses 3, while box beam 8, opposite 7, supports pan 10 opposite 9.

Figures 3, 9, 10, 11, 12:
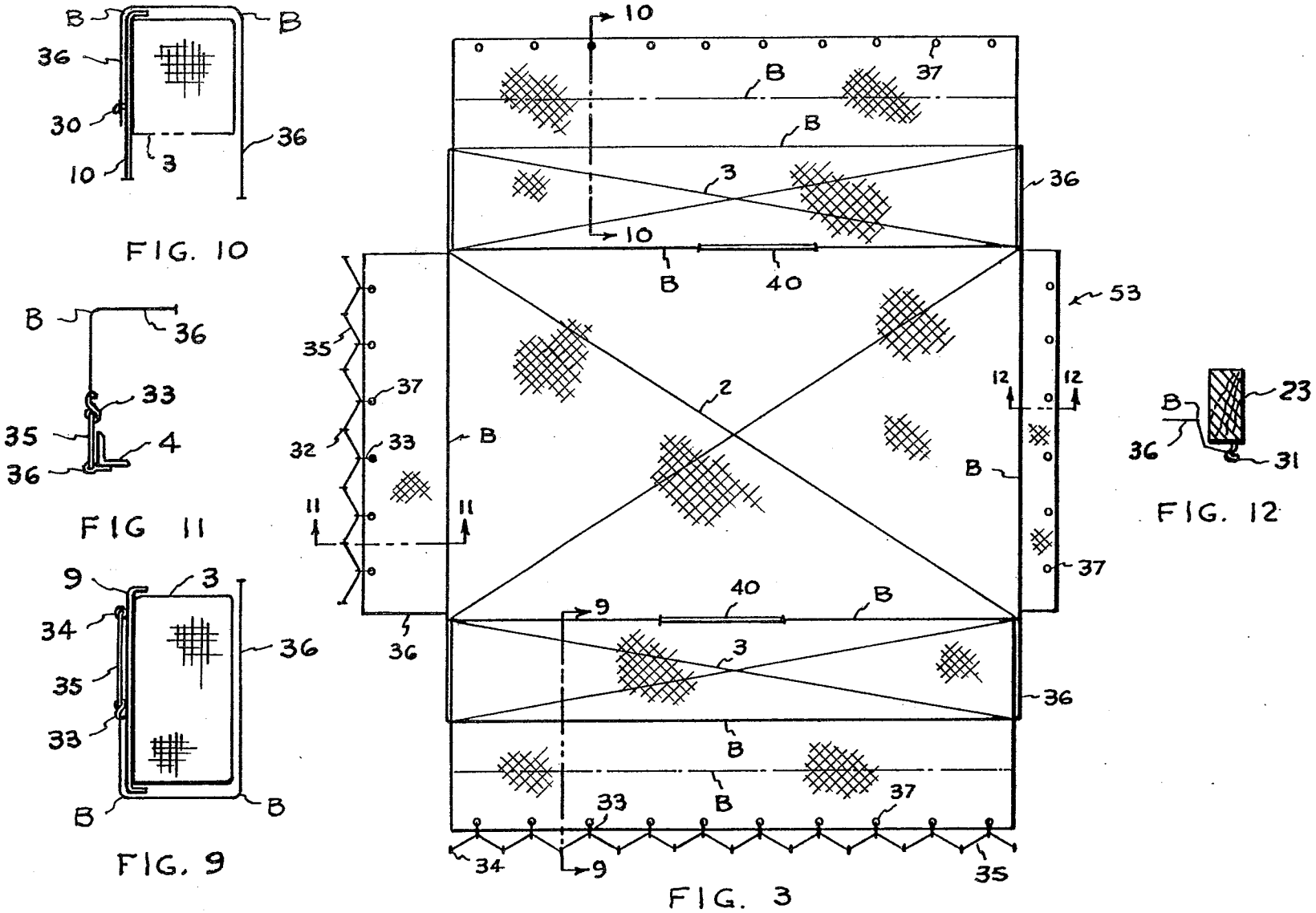
FIG. 3, is a plan view of the bed looking down from the top and showing the profile and attachments of the bed sheet.

A plurality of eye studs 32 are permanently secured to the outermost bottom of the foot end support structure 4 common to the area of box spring 1 for attaching elastic chord 35. The two side mattresses 3 are each separately set into the bottom side mattress support pans 9 and 10. Each cover the entire bottom of the side mattresses 3 forming an enclosure of the mattress bottom when it is rotatated to a vertical position. A plurality of hardware securing the pan to the mattress is not shown. Pans 9 and 10 are flanged on all sides to position in general the mattress. A plurality of hooks 30 run along the bottom of pan 10 in its entire length as shown in FIG. 10 cross section. A plurality of eye studs 32 run along the bottom of pan 9 in its entire length as shown in FIG. 9 cross section. Hooks 30 secure the attach points for eyelets 37 of sheet 36 while eye studs 32 secure elastic chord 35 to pan 9. Both pans 9 and 10 are moveable through a 90 degree arc. Outer hinge mountings 11, inner hinge mountings 13 and 14 and hinge bushings 15 allow this rotation. Hinge mountings 11 mount to the end structures 4 and 6. Hinge mounting 13 and 14 mount to ends and bottom of pan 9 and 10. Hinge spacer washer 28 mounts on bushing 15 between outer and inner hinge plates shown in FIG. 6. Hinge bushings 15 journal the two mating hinge plates. It is positioned by a shoulder on one end and retained on the other by retainer ring 27. The centerline of hinge unit is in alignment with the top surface plane of both mattresses 2 and 3 and with the common abuttment position in the vertical axis. Headboard attach plates 17 are secured to the head end of box beams 7 and 8 and are for securely securing headboard 50 to the frame. Foot end box beam enclosure caps 38 enclose the foot end of box beams 7 and 8 restricting access and providing finish. A plurality of attaching hardware 39 secures caps 38.

Both the left hand post 20 and the right hand post 21 of headboard 50 run vertical from the bottom of headboard attach plates 17 to a dimension in the order of thirty inches above the top surface plane of the mattresses when laid flat. This room is necessary to provide for the combinations of the occupant's supports required of the headboard. A top rail 22 mounts above posts 20 and 21 and runs the width of the bed. A lower rail 23 runs between posts 20 and 21. Its' top surface is in general about two and one-half inches above the top surface plane of the mattresses. The posts and rails are made sufficiently strong to support a plurality of turned spindles 24 running vertical between upper and lower rails and sufficiently spaced to be grasped by the occupant's hand. A plurality of hand support straps 46 are secured around top rail 22. These are adjustable straps buckled in a loop with one loop running through the other as it surrounds top rail 22. The straps allow occupant to secure hand by laying it in the loop formed stretching out both arm and body and thus reducing pressure to a degree on the spinal column. The turned spindle 24 are turned in a manner to provide a multitude of hand gripping locations that also allow stretching out both arm and body reducing pressure on the spinal column and to further provide secure anchor grip points, whereby occupant may shift body position by the use of hand and arm in lieu of spinal column muscles. The headboard further provides for control switches 29 mounted conveniently to lower rail 23 for independent side mattress operation. The headboard is attached with a plurality of attaching hardware 25 securing it to the frame. Hooks 31 are installed along the lower surface of lower rail 23 as shown in FIG. 12. They run common to center mattress 2 for securing eyelets 37 in sheet 36.

Figures 4, 5, 6, 6A, 7, 7A, 8, 8A:
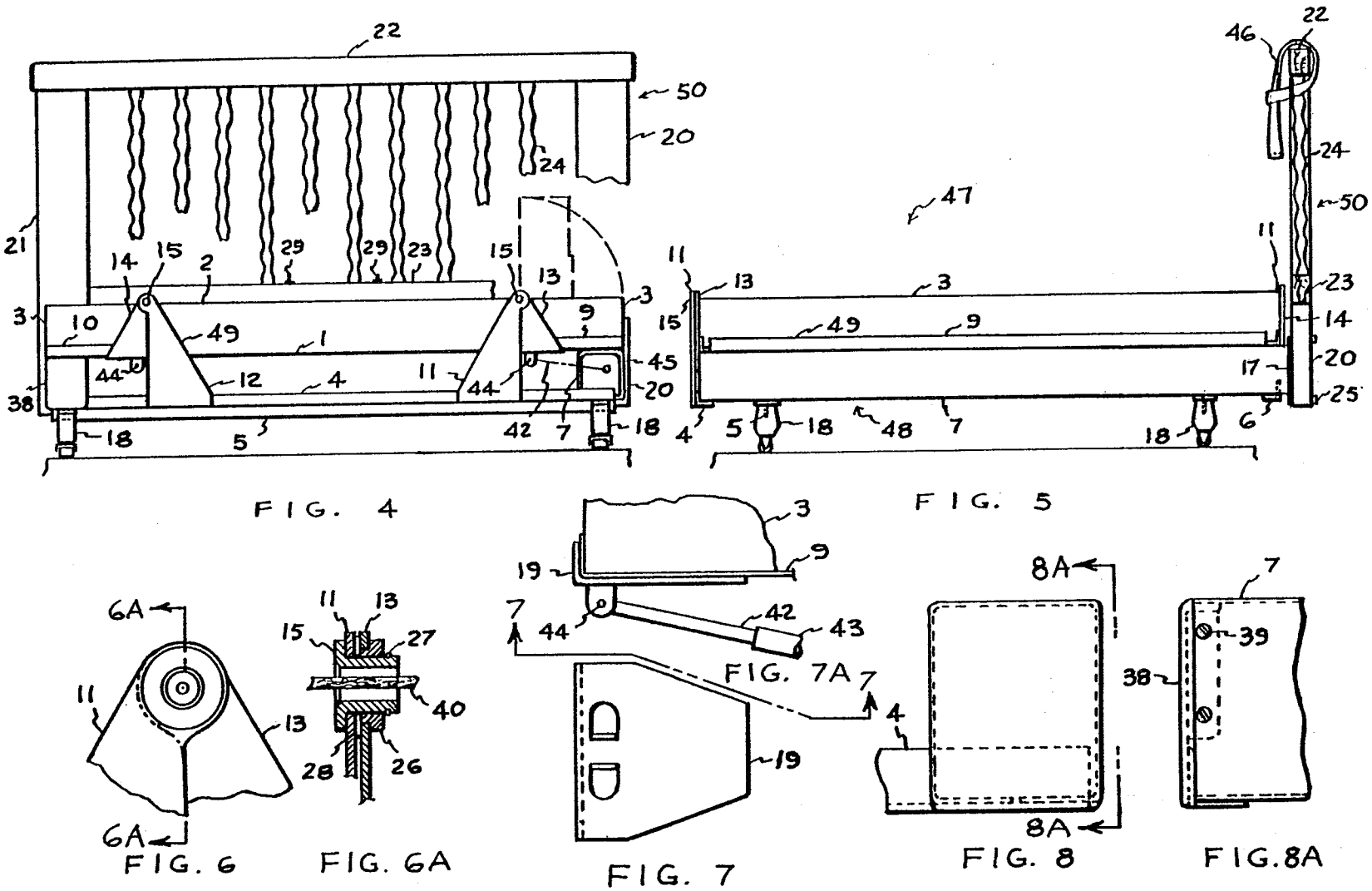
FIG. 4, is a cross sectional view of the bed and a partial view of the headboard as viewed from the foot end of the bed.
FIG. 5, is a side view of the bed.
FIGS. 6 and 6A are details showing a pivot hinge arrangement of the foldup mattress.
FIGS. 7 and 7A are partial details showing the actuator arm connected to the moveable mattress supporting section.
FIGS. 8 and 8A show a partial detail arrangement of the box beam supporting the moveable mattress sections.

Power unit and gear box 41 in power group 51 is partially mounted within box beams 7 and 8, not shown in detail. The lower actuator arm 42 operates out of the gear box. Extending within this actuator is upper actuator arm 42. A frame mounting 19 is secured to the bottom of each side mattress support pan 9 and 10 and is flanged up common to their inside surfaces, shown in FIGS. 7 and 7A. Two cutouts are made in the bottom surface and are flanged down common to one side to provide mounting for the actuator pin 44. The power unit and mounting are located along box beam 7 and 8 to provide actuation near the mid point of the structure being moved. The actuator moves the side mattresses 3 from horizontal to vertical position and back as shown in FIG. 4.

Box spring 1 in mattress group 52 supports center mattress 2. It may be in size equivalent to a single, double, queen or king size mattress. The side mattresses 3 run the full length of the bed and are generally in the order of a fourteen inch width. There are no box springs beneath these mattresses. The elevation of frame mountings are such that the upper surfaces of all mattress units are elevated to the same plane when positioned in a horizontal position.

The completed bed 50 is covered with a sheet that remains taught in any adjustable position of the mattresses. The sheet 36 is cut in profile to encase all upper mattress surfaces and the side mattresses on their outermost sides and the center mattress across the ends. All sheet fold lines are shown by reference "B". Sheet 36 is provided with eyelets 37 on four sides. The eyelets on two sides are hooked over hooks 30 and 31. On the opposite sides they are secured by eye hooks 33. Eye hooks 33 are laced through elastic chords 35 alternately with eye studs 32. Each elastic chord 35 is secured near the ends of the sheet width under tension. When eye hooks 33 are inserted in eyelets 37 elastic chord 35 applys tension to sheet 36 at all times. In this configuration the sheet is held securely while mattresses lay flat. A flat web nylon chord 40 runs over sheet 36 common to the side mattress hinge centerlines. The ends extend through holes in hinge bushing 15 and are secured under tension. This keeps sheet 36 snugly in position independent of mattress rotation.

The support bed provides the occupant's spinal column support in two planes and is easy accessible in and out of the bed. The headboard arrangement allows the occupant anchor points, whereby the body can be slightly stretched by the hands and/or arms, all of which ease pressure on injured nerves and/or vertebra common to ailing back problems. The headboard anchors further allow occupant to reshift body position without excess back muscle strain.

While preferred embodiments of the invention have been described herein, it is appreciated that further variations and modifications may be made without departing from the spirit of the invention.

I claim:

1. A support bed which comprises: a main frame for supporting a box spring and a center mattress, said main frame having a head end, a foot end, a right side, and a left side; said main frame comprising: a pair of box beams extending in a longitudinal direction, said box beams forming the left and right side of the main frame; a longitudinal support structure located between said box beams, said longitudinal support structure supporting said center mattress and box spring; a head end support structure connected transversely to said box beams and said longitudinal support structure; a foot end support structure connected transversely to said box beam and said longitudinal support structure; an intermediate support structure connected transversely to said box beams and said longitudinal support structure; a pair of auxiliary frames, one located on the left side of the main frame, the other located on the right side of the main frame, said pair of auxiliary frames supporting a pair of side mattresses, each of said auxiliary frames comprising a mattress support pan: hinge means connecting the auxiliary frames to the main frame, said hinge means comprising: inner hinge mounts connected to the ends of said mattress pans; outer hinge mounts connected to said foot end and head end support structure inner bushings set into said inner hinge mounts; outer bushings set into said inner bushings forming hinge points about which mattress support pans can rotate through a ninety-degree arc; and a power means for rotating said auxiliary frames independently of each other from a horizontal plane to a vertical plane.

2. The support bed of claim 1, said support bed having a headboard comprising; headboard attaching plates mounted to the head end of said box beams; a left hand and right hand post attached to said headboard attaching plates; a top and bottom rail interconnecting said right hand and left hand posts; a plurality of equally spaced spindles secured between said top and bottom rails; a plurality of hand support straps secured intermittently about said top rail; a control means mounted to said lower rail for operating said power means.

3. A support as recited in claim 2, wherein a plurality of hand grips are turned on each spindle.

4. A support bed as recited in claim 2, wherein the hand support straps are adjustable in length and when secured at their ends form a loop which is wrapped around the top rail with one end of the loop laced through the other and then pulled through, whereby the extended loop forms a hand support.

5. A support bed as recited in claim 1, wherein the upper surface of said center mattress and said side mattresses form a common plane when laid flat in a horizontal plane.

6. A support bed as recited in claim 1, wherein the hinge means in adjacent the juncture of the upper surfaces of said center mattress and said side mattresses.

* * * * *